US005117540A

United States Patent [19]

Walton et al.

[11] Patent Number: 5,117,540

[45] Date of Patent: Jun. 2, 1992

[54] LONGITUDINAL COMPRESSIVE TREATMENT OF WEB MATERIALS

[75] Inventors: Richard R. Walton, Ten West Hill Pl., Boston, Mass. 02114; George E. Munchbach, Roslindale, Mass.; Richard C. Walton, Wellesley Hills, Mass.

[73] Assignee: Richard R. Walton, Boston, Mass.

[21] Appl. No.: 587,017

[22] Filed: Sep. 24, 1990

[51] Int. Cl.[5] ..... D06C 21/00

[52] U.S. Cl. ..... 26/18.6

[58] Field of Search ..... 26/18.5, 18.6

[56] References Cited

U.S. PATENT DOCUMENTS

| | | |
|---|---|---|
| 1,690,411 | 11/1928 | Hudson . |
| 1,751,471 | 3/1930 | Campbell . |
| 2,309,585 | 1/1943 | Haddock . |
| 2,320,891 | 2/1942 | Ryder, Jr. . |
| 2,851,206 | 9/1958 | Guenther et al. . |
| 2,958,608 | 11/1960 | Barnard . |
| 3,089,415 | 5/1963 | Grembecki et al. . |
| 3,260,778 | 7/1966 | Walton . |
| 3,353,222 | 11/1967 | Keel et al. . |
| 3,426,405 | 2/1969 | Walton . |
| 3,447,221 | 6/1969 | Odiorne . |
| 3,810,280 | 5/1974 | Walton et al. . |
| 3,975,806 | 8/1976 | Walton et al. . |
| 3,981,085 | 9/1976 | Franko . |
| 3,992,000 | 11/1976 | Martin . |
| 4,041,581 | 8/1977 | Diggle, Jr. . |
| 4,052,150 | 10/1977 | Behun . |
| 4,142,278 | 3/1979 | Walton et al. . |
| 4,291,438 | 9/1981 | Seiki et al. . |
| 4,627,137 | 12/1986 | Wildt . |
| 4,698,052 | 10/1987 | Slobodkin . |
| 4,796,880 | 1/1989 | Tamary . |
| 4,882,819 | 11/1989 | Milligan et al. . |
| 4,899,863 | 2/1990 | Settles . |

FOREIGN PATENT DOCUMENTS

| | | | |
|---|---|---|---|
| 1167627 | 5/1984 | Canada | 28/18.6 |
| 130463 | 5/1902 | Fed. Rep. of Germany . | |
| 1955196 | 11/1969 | Fed. Rep. of Germany . | |
| 2116593 | 9/1983 | United Kingdom | 28/18.6 |

*Primary Examiner*—Werner H. Schroeder
*Assistant Examiner*—John J. Calvert
*Attorney, Agent, or Firm*—Fish & Richardson

[57] ABSTRACT

Machines and methods for longitudinal compressive treatment of a web are shown. A retarder blade disposed adjacent a roll provides a web-contacting slide surface to which the longitudinally compressed web transfers and upon which it slides as it leaves the roll. This retarder blade has two spaced-apart roll-contacting regions disposed toward the roll, one of the roll-contacting regions being at the forward tip of the blade near the drive region and the second roll-contacting region being at a heel region spaced downstream. A pair of drive rolls defines a nip for driving the web forward, the surface of each of the rolls comprising a series of principle web-gripping grooves extending in only one direction helically about the roll axis. At the nip line of the rolls the angle of the grooves of one roll is inclined positively relative to the direction of travel of the web, and the angle of the grooves of the other roll is inclined negatively relative to the direction of travel of the web. Special roll contours and special forms of the blade construction, and other features of the driving and retarding passages are described.

38 Claims, 11 Drawing Sheets

LONGITUDINAL COMPRESSIVE TREATMENT OF WEB MATERIALS

BACKGROUND OF THE INVENTION

This invention concerns improvements in longitudinal compressive treatment of web materials and has particular application to microcreping and the softening of webs.

In U.S. Pat. No. 4,142,278, which is incorporated herein by reference, a two-roll longitudinal compressive treatment machine is shown in which one or two retarder blade elements are held in special relationship to the nip to impede the flow of the web for retarding and causing longitudinal compression of the web. The present invention provides improvements involving the rolls and the blades that enable the desirable characteristics of such two-roll machines and methods and other machines using web-drive rolls to be realized efficiently in commercial practice.

The invention also provides new approaches to designs of retarder blades that, in addition to being important in two-roll treatments, are more widely applicable, e.g. to single roll microcreping such as illustrated in U.S. Pat. Nos. 3,260,778 and 3,426,405, which are also incorporated herein by reference.

With machines and methods for longitudinal compressive treatment of web materials, there have been difficulties in achieving continuously reliable treatment, especially in the case of web materials that are highly heat-sensitive or have "stickiness" that makes them difficult to drive and process. There have also been problems related to general machine construction, blade stability and difficulty of maintaining proper process adjustment for the more difficult-to-treat materials. The present invention addresses these problems as well as providing general features useful in microcreping.

SUMMARY OF THE INVENTION

According to one important aspect of the invention, a machine and method using the machine for longitudinal compressive treatment of a web employs at least one drive roll, means for pressing the web against the roll in a drive region to cause the web to be driven forward and means for retarding the forward progress of the web to cause longitudinal compressive treatment of the web in a treatment cavity downstream of the drive region and in advance of the retarder means, the treatment cavity defined by the forward surface of the roll and a cooperating opposed surface, the retarder means comprising a retarder blade disposed adjacent the roll and providing a web-contacting slide surface to which the longitudinally compressed web transfers and upon which it slides as it leaves the roll, the retarder blade having two spaced-apart roll-contacting regions disposed toward the roll, one of the roll-contacting regions being at the forward tip of the blade near the drive region and the second roll-contacting region being at a heel region spaced downstream therefrom, the blade extending in cantilever fashion from the heel region to the tip region, the thickness and shape of the tip region of the blade and the length between the heel and tip regions enabling the tip of the blade to be deflectable by oncoming longitudinally compressed material to maintain proximity of the tip to the roll surface along the length of the roll in manner inhibiting diving or snagging of the material at the tip, thereby to promote the smooth, even exiting movement of the material from the treatment cavity.

In preferred embodiments, the blade has a body that is thicker at the heel region than at the tip region, and the tip of the blade is curved toward the roll.

Preferred embodiments have one or more of the following features. The distance between the heel and tip roll-contacting regions is of the order of ¼ inch or less; the blade comprises a blue steel member having a main body of substantially uniform thickness and a forward region of less than ½ inch length reduced in thickness from the main body to the tip; the thickness of the tip is about 0.005 inch or less and the main body has a thickness greater than 0.010 inch, preferably the main body having a thickness of about 0.020 inch or greater; the forward part of the blade tapers evenly over a length of less than one half inch to a thickness less than 0.005 inch at the tip; the tip of the blade is curved with radius of curvature being in the range of about 1/32 to ¼ inch; the means for pressing the web against the roll comprises a second roll; the retarder means comprises a second blade of like construction, the second blade engaged in two-region contact with the second roll and the diameter of each of the rolls is greater than 8 inches.

Also in preferred embodiments employing the blade structure, the driving surface of each of the rolls comprises a series of principal web-gripping grooves extending in only one direction helically about the roll axis, preferably there being between about 20 to 80 grooves per inch and the grooves extending at an angle to the direction of travel of the web between about 10° to 35°, at the nip line of the rolls the angle of the grooves of one roll inclined positively relative to the direction of travel of the web, and the angle of the other roll inclined negatively relative to the direction of travel of the web.

According to another important aspect of the invention, a machine and method using the machine for compressive treatment of a web employs a pair of drive rolls defining a nip for driving the web forward and retarder means for retarding the forward progress of the web to cause compaction of the web in the cavity between the rolls downstream of the nip, the driving surface of each of the rolls comprising a series of principal web-gripping grooves extending in only one direction helically about the roll axis, at the nip line of the rolls the angle of the grooves of one roll inclined positively relative to the direction of travel of the web, and the angle of the grooves of the other roll inclined negatively relative to the direction of travel of the web.

In preferred embodiments, there are between about 20 to 80 grooves per inch and the grooves extend at an angle to the direction of travel of the web between about 10° to 35°; there are smooth-surfaced lands between the grooves, upon which the web slides as it is compacted; the lands are wider than grooves, preferably the lands being at least twice as wide as the grooves, e.g. between 2 and 4 times as wide as the grooves. Also preferably the grooves are "V" shaped grooves formed by knurling, and for forming the preferred lands the grooves are formed by knurling followed by a metal removal operation removing outer portions of the knurled formation, preferably, by grinding. In particular preferred embodiments the relationship of the angle of the grooves to the number of grooves per inch is generally in accordance with the following table:

| Angle | Pitch (grooves/inch) |
|---|---|
| 35° | 20 |
| 30° | 30 |
| 25° | 40 |
| 20° | 50 |
| 15° | 60 |
| 10° | 80. |

In various of the preferred embodiments, the first retarder blade is located forward of a second blade held adjacent the other of the rolls of a two roll machine; the latter blade comprises a resilient valving member; during running condition, the passage defined between the blade members diverges continuously in the downstream direction from the tips of the blades.

In other embodiments, the retarder means comprises a single retarder blade, the foward part of which is held adjacent one roll and a downstream surface of which having a retarding quality is adapted to be pressed toward the opposite roll to engage and retard the exiting material.

BRIEF DESCRIPTION OF THE DRAWINGS

FIG. 2 is a detail of the end view of FIG. 1 showing the nip and blade assemblies, while

FIGS. 10*a–d* illustrate stages in the manufacture of a blade made according to the invention while

FIG. 11 is a diagrammatic, perspective view of a blade of FIG. 8 resting on its roll; while

GENERAL DESCRIPTION

Figure 1:
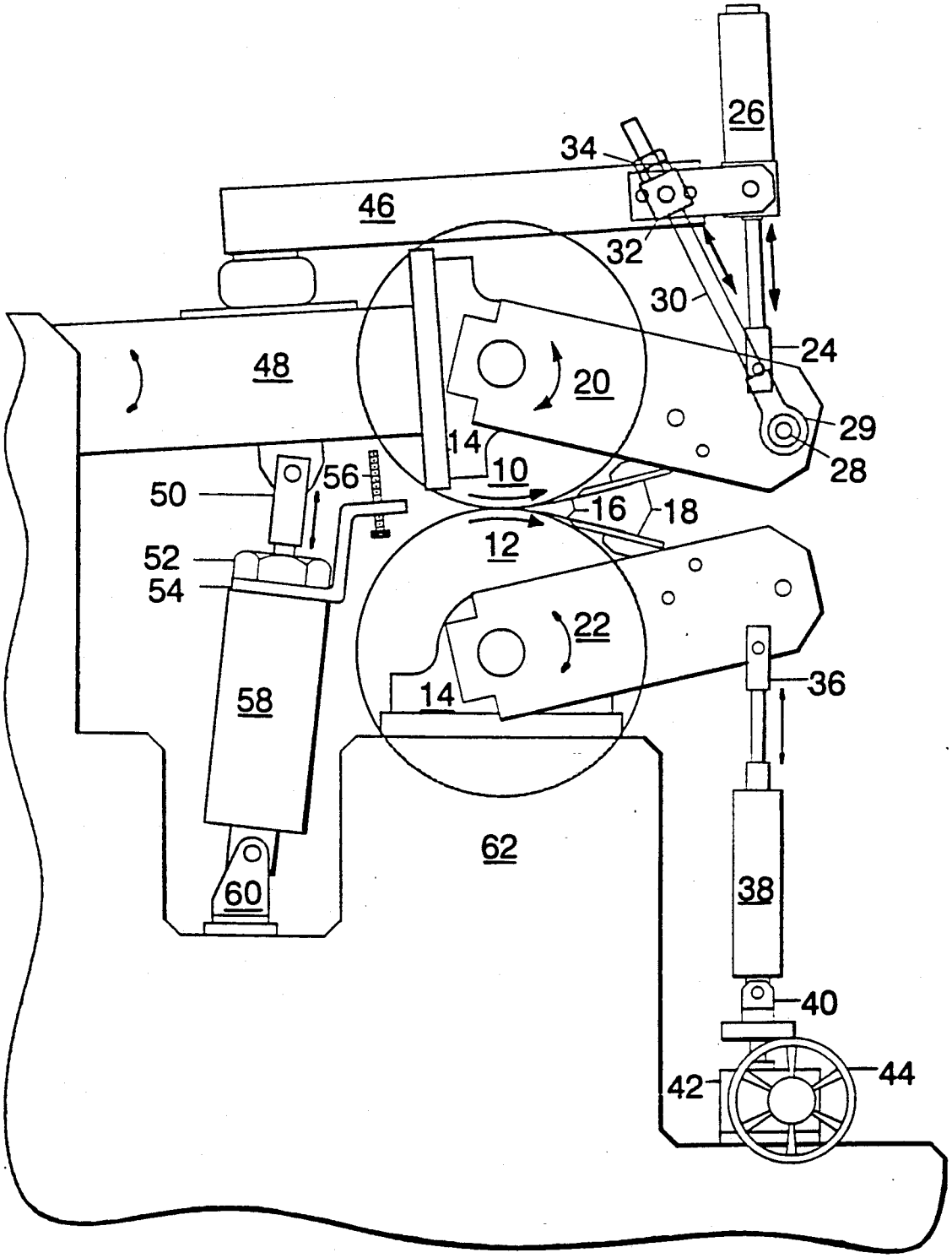
FIG. 1 is an end view of a machine assembly according to a preferred embodiment of the invention.

According to one aspect of the invention, the rolls of a two roll longitudinal compressive treatment machine and method are provided with a predominant drive feature in the form of single direction helical grooves, preferably provided by knurling. The grooves extend in the same direction on each roll such that when the rolls are counter-rotated together in a nip, the grooves cross each other progressively as rotation proceeds. The preferred range of the angle of the grooves is 10° to less than 45°, taken in relation to the direction of travel of the web. More preferably, the range of the angles is between 15° and 35°. The particular angle is preferably selected dependent upon the particular type of material to be treated, the nature of the desired treatment, and the pitch, i.e., the center-to-center distance between grooves, taken in the direction of the axis of the roll. In general, with finer pitch, the angle is less, and with larger pitch, the angle of the groove is greater.

This single direction groove arrangement is found to have a considerable benefit in that as the two sets of grooves, forming an angle with one another, move relative to one another as the roll turns, the web between these rolls is positively gripped by the cooperation of the angles and is driven forward. This web drive occurs as rotation proceeds in the manner that at any instant the web is positively driven at the nip line at a series of spaced-apart small regions, and the position of these small regions progressively changes in opposite lateral directions on the different sides of the web as the rolls turn. Not only is the web positively driven forward, but also it tends to be driven straight due to the counterbalancing effects of the different set of the angles on the two sides of the web.

After thus being driven positively, as each increment of web leaves the nip, there is rapid, ready release of the grip of the rolls on that part of the web, which is very beneficial. To explain more fully, in starting the treatment process, the material is caused to jam back or create a column of material in the treatment cavity upstream of the retarder elements. Turning of the rolls forces fresh material to be driven forward and compacted against the column. As additional material is thus added to the column preceding the retarder blades, treated material of the other end of the column is released at the exit from between the retarders. The major compacting action occurs in a very small initial region of the cavity immediately following the drive nip. As the web material leaves the positive grip of the rolls and slows as it enters the treatment cavity, it must slide upon the rotating rolls that advance past it at greater speed. The single direction grooves at the opposite angles prescribed permits the material to readily slide back relative to the advancing roll surfaces without significant abrasion or other detrimental degrading action of the roll surface on the web.

It is found in many instances, that rather than having one complete groove immediately adjacent another in saw-tooth profile, it is advantageous to grind off (or otherwise avoid having) top pointed portions at the intersections of walls defining the grooves. Instead, smooth transition surfaces or lands are provided. Preferably, these transition surfaces are of the form of flat (i.e. cylindrical) lands lying between the grooves. The transition surfaces add to the ease with which the treated web material slides upon the surface of the rolls as the web is released from the positive grip of the grooves in the roll surface and is compressed. In the particularly preferred embodiment, during manufacture, after complete knurling of the rolls in one direction, the roll material is ground off to conform to a smaller cylinder such that the lands between the grooves are wider than the grooves themselves. In the most presently preferred embodiment the land width, L, is equal to two and one half times the groove width, G.

The particular frequency, angle, and depth of the grooves depends upon the particular nature of the material being treated. The pitch of the grooves can vary over a significant range, typically the angle of the groove to the direction of travel being adjusted in a corresponding manner. In operable embodiments, the pitch may range from, for instance, 20 to 60 to 80 grooves per inch of axial length of the roll. In preferred form, the general relationship of the angle mentioned above to the number of grooves per inch is generally in accordance with the following table.

| Angle | Pitch (grooves/inch) |
|---|---|
| 35° | 20 |
| 30 | 30 |
| 25 | 40 |
| 20 | 50 |
| 15 | 60 |
| 10 | 80 |

With respect to the presence and width of the lands relative to the grooves, we have already suggested that with no lands between the grooves, certain materials can advantageously be driven. One example is jersey knit material.

In an example where the width of the lands bears the ratio two to one to the width of the grooves, this, like the embodiment with no lands, may tend to leave patterns in certain materials, but is useful, for instance, with a number of non-woven and woven materials, for instance, a jute woven material and the like.

For a more nearly-universal machine, i.e., a machine which can treat materials having a rather wide range of characteristics, it is presently preferred that the ratio be 2½ to 1, land width to groove width. In that machine, it is presently preferred that there be a pitch of about 50 grooves per inch and an angle of the grooves to the direction of travel of the web (sometimes called the machine direction) of 20°. It is presently preferred that these grooves are of "V" profile, formed by knurling as it is found that the material releases readily from such formations.

For very thin and delicate web materials that are to be treated such as tissue, the land-to-groove width ratio may be 4 to 1. It is found that with ratios, especially of 3 to 1 or 4 to 1, it is possible to avoid marking of even very sensitive webs when the webs are driven through the nip of the machine and through the compressive treatment.

One of the important uses of this machine is for softening of non-woven materials or webs, these typically being made in a paper machine-like process or in the so-called spun-bonded process where the web fibers are bonded together by adhesive material. The untreated web is typically rather stiff and harsh and paper-like, and the object of the treatment is to soften the web. In that case, the material is longitudinally compressed or microcroped by the machine and then virtually all of the compaction or microcrepes are pulled out. The action of the treatment serves to loosen the fiber bonds and to render the web soft, pliable and drapable and with a pleasing hand, soft to the touch, and in certain instances, more absorbent.

An analogous action is performed on numerous papers and on various textile fabrics, both knit and woven, to change texture to impart a controlled degree of stretchiness, etc.

Another contribution of the present invention concerns retarder blades that contact their respective rolls with two-point contact and the nature of the passage thus defined between the blades. This construction features engagement of the blade both at a heel region at a location slightly downstream of the upstream tip of the retarder, and at the tip itself, with space between roll and blade therebetween. Preferably, the very tip of the blade is curved toward the roll and the blade in that region is so thin that it responds to force applied by the web material itself, to keep the tip down against the roll. This construction cooperates with the single direction grooved rolls that have just been described in a highly effective manner, and especially when each of the pair of rolls is of large diameter, e.g., 8 to 10 inch, mentioned more fully below. But the two-point-contact blades also can be used to advantage in other microoreper machines as described in the above-referenced patents.

It is found particularly advantageous to employ blades of considerable thickness, for instance of blue steel, 0.020 inch thickness or greater, with an end portion (of e.g., ¼ inch length for a blade of 0.020 inch thickness) being tapered as by grinding from the original thickness down to a relatively thin tip of, e.g., 0.005 or 0.004 inch. With such a blade, even where the diameter of each of the rolls is in the range of 8 to 10 inches, it is possible to hold the blades at a diverging angle relative to the tangent plane projected from the nip to provide a divergent character to the outward retarder passage beyond the forward tip of the blade. Such divergence provides particularly smooth retarding and release of the treated material as the material is pulled from the machine for further treatment.

It has been found, with prior arrangements, that there is some tendency for certain materials to snag or dive under the tip of a retarder blade when the material is being driven forward. According to an important aspect of the invention alluded to above, this can be avoided by forming the tip of the retarder blade as a so-called web-reactive curtain in which the compacted material itself holds the tip of the retarder in direct contact with the roll surface. This is illustrated in the accompanying drawings. To achieve this in the preferred embodiment, the retarder blade with the original thickness of 0.020 inch and the taper down to the 0.004 inch over a distance e.g. of 0.250 inch, has its tip portion, for instance a margin of 1/16 inch, passed through a curve-forming roll process, e.g., a radiused roller, which is held against a hard but resilient cylindrical anvil roller, such as of nylon. The end of the tip of the blade is thus deformed into a curve such that it is displaced, in an example, approximately 0.010 inch below a plane projected along the original back of the blade. It is found that by holding such a retarder blade directly against the roll, the blade may be made to bear with a heel portion on the roll, the heel being e.g. in the range of ⅛ or ¼ inch downstream of the tip, and at the same time, the tip or the so-called web-reactive curtain, will also touch the roll or be held in immediate, direct proximity thereto. It is found that the oncoming treated material, while being diverted from the roll surface by such a retarder, tends in a self-actuating way, to hold the tip of the retarder against the roll to defeat any tendency for the material to snag or dive and this can occur without there being rapid wear on the tip after an initial "wearing in" period.

In tests with a six inch roll it was shown to be preferable to locate the curve in the blade as near as possible to the end of the tip, consistent with not rippling or otherwise distorting the final edge. Such location of the curve helps to assure that no microcreping occurs so late as to be over the blade surface, and this helps to assure that there is no diving or snagging of the material.

In one preferred set of blades, an example of which is shown in one of the figures, the second or downstream blade is comprised of a backer member together with a so-called resilient valving member, a function of which is to fill the cavity at the start-up of the machine to hold back the material, to initiate the microcreping or compacting process. The geometry and stiffness of the valving member may be selected, depending upon the stiffness of the material to be treated, to flatten entirely against the second retarder and not to form any significant obstruction to the material after the process has been initiated, though even in this case it may provide a certain desirable buffering function, to aid in the smooth processing of the web material through the machine. The actual thickness of the substance of this valving member depends upon the amount of initial resistance desired at start-up. For instance, it may be of blue spring steel as thin as 0.002 inch or 0.003 inch thickness for tissue paper, but with stiff materials such as sterile wrap used in hospitals or other non-woven materials, the thickness may be as great as 0.006 inch. The valving member, when thick enough, can be used by itself in direct contact with the roll, without the top blade.

In other cases the valving member can be made with sufficient properties to contribute a retarding function, the degree of retarding attained being controlled e.g., by selection of the degree of resilience (stiffness) of the material of the valving member and the friction quality of the surface of the valving member.

Broader aspects of the invention include use of a single retarder member, functioning as described in U.S. Pat. No. 4,142,278 to which reference is made.

A further feature of the invention concerns the realization that, contrary to prior opinion by some practicing in the field, the two-roll type of action can be achieved not only by using rolls of 5 or 6 inch diameter, but also by using rolls significantly larger than the 5 inch or 6 inch diameter. For instance, it has been found that a pair of rolls with diameters as large as 8 inch or 10 inch can be employed. In the past it had been suggested that it would not be possible to provide properly shaped retarder blades of sufficient thickness and durability that could be inserted sufficiently deeply into the nip to define the required short microcreping treatment cavity if such large rolls were employed. It has been shown according to the invention, however, that when employing large diameter rolls, the length of the cavity need not be as short as had previously been thought necessary; indeed it has been discovered that the permissible length of the treatment cavity appears to increase linearly with roll diameter for the two roll machine. This has great potential advantage because it enables robust retarder blades to be employed while obtaining advantages of large rolls such as much larger unsupported span width. Indeed, the longer treatment cavity is found to relax the requirement for longitudinal resiliency in the retarder blade set up, and appears to provide a more reliable way to operate the machine. This is believed to be attributable to the fact that the column of treated web material in the treatment cavity is itself resilient, and this column, being longer when the rolls are larger in diameter, results in the column itself contributing greater total resiliency to the system. It is found that even with non-wovens that themselves are not regarded as highly resilient, still with the large diameter rolls, it is possible to rigidly locate both retarder blades in their longitudinal positions and depend upon the self-resiliency of the column of treated web in the treatment cavity to absorb variations that occur and ensure a smooth flow and treatment of the web.

It is interesting to note as a side light that much of the design of longitudinal compressive treatment machines and microcrepers has been explained in the past by analogy to the attempted pushing of a rope through a tube. It is known that a short length of rope can easily be pushed through a tube. If one tries to push a longer piece of rope through the tube, the aggregate frictional resistance applied to the rope by the tube wall tends to cause the tube to compress, thicken and shorten; and as it gets thicker, it creates even more frictional resistance against the inside wall of the tube, the compounding effect being to cause the rope to jam and not move through the tube. Using this analogy, Mr. Richard R. Walton, and his coworkers, over the past 30 years, have realized the importance of short treatment cavities for microcreper machines to avoid jamming of the machine during treatment, and the corpus of his work and those who have followed him has emphasized the necessity of using very short treatment cavities.

As noted above, there is a difficulty in getting blades close to the center line of the cavity in a two-roll machine that is formed of rolls of large diameter, given the gradualness of the divergence of the surfaces of the relatively large rolls from one another. It has been found, though, by experiment, that in fact, even if the new lades herein described are held back the distance required by the geometry, and even sufficiently that the blades can diverge, highly satisfactory microcreping or longitudinal compressive treatment can occur. While blades of 0.020 inch thickness are described herein, it is anticipated that blades with thickness of 0.030, 0.040, 0.050 inch thickness, with suitable reduction in thickness in the tip region as described herein, may in the future be used in the practice of the inventions described, using large rolls.

As for why the treatment cavity can be longer in two roll machine having large rolls, it is hypothesized that the fact that both sides of the treatment cavity defined by the rolls are moving, means that not only does the previously useful analogy of pushing a rope-in-a-tube not apply, but in fact an opposite and beneficial effect is obtained. If the web thickens and applies increased pressure to the sides of the passage defined in this case by the two turning rolls, because the roll surfaces are both moving the material engages the roll surface more tightly, and causes an increased drive force to be applied to the surface of the treated column, resulting in the material being driven out more quickly, and vice versa if the oncoming web is thinner. Thus the machine becomes more self regulating, when large rolls are employed, instead of being jammed as occurs with a rope in a tube. This action is seen as permitting, in the preferred embodiment, the machine rolls of a 2 roll machine to be 8 or 10 inch or more in diameter, and this has the beneficial result that a roll of a stable geometry can be made longer, to allow use in production lines for non-wovens whose width may be 60 inch or 76 inch or more. For narrower widths or other circumstances, of course, rolls of 5 or 6 inch diameter can also be employed to advantage using the rolls, blades and relationships provided by the present invention.

DESCRIPTION OF PRESENTLY PREFERRED EMBODIMENT

The embodiment to be described employs two rolls of large diameter but is a machine built as a demonstrator of the principles of operation, and is of short axial length.

Referring to FIG. i, an end view of a machine assembly according to the preferred embodiment of the invention is shown. There are two counter-rotating rolls, a top roll 10, and a bottom roll 12, rotating in the directions of their respective arrows, the top roll 10 rotating counterclockwise, and the bottom roll 12 rotating clockwise. The rolls 10 and 12, both e.g. of 8 inch to 10 inch diameter, are mounted on identical bearings 14 at each end of both of the rolls. The bearings 14 at either end of the top roll 10 are disposed at the end of rotating cantilever arms 48 which are also located at either end of the top roll 10. The rotating cantilever arms 48 are, in turn, attached to respective sides 62 of the main machine frame, and rotate about their attachments as illustrated by the upper left arcuate arrow in FIG. 1. The bearings 14 at either end of the bottom roll 12 are also mounted on respective sides 62 of the main machine frame, generally not at the same places where the rotating cantilever arms 48 are attached. Both rolls 10 and 12 are driven (motor and gearing not shown).

The region of shortest distance between the top roll 10 and the bottom roll 12 is the drive or nip region. Web material introduced upstream, from the left in FIG. 1, of the rolls 10 and 12 is driven downstream, to the right in FIG. 1, on passage through the drive region between the counter-rotating rolls 10 and 12. Downstream of the drive region there are a pair of identical blades 16 mounted on a pair of blade holders 18. Both blades 16 and blade holders 18 extend along the length of the respective rolls 10 and 12.

The blade 16 contacting the top roll 10 is mounted on a blade holder 18 that is affixed to a pair of top pivotinq arms 20 at either end of the top roll 10, the blade 16, blade holder 18, and top pivoting arms 20 constituting a blade assembly. The top pivoting arms 20 pivot about the central axis of the top roll 10, as indicated by the upper right arcuate arrow in FIG. 1, in such a manner that the blade 16 maintains a substantially constant angular relationship with the surface of the top roll 10. The pivoting action of pivot arm 20 can be effected by a pair of double-acting air cylinders 26, providing up and down movement as demonstrated by the upper right two-headed arrow in FIG. 1, connected to the top pivot arms 20 through clevises 24. The air cylinders 26 are mounted on support arms 46 at either end of the top roll 10, with the support arms 46, in turn, mounted on the rotating cantilever arm 48. Stopping mechanisms and positioning assemblies for the top pivot arms 20 are provided by a centrally positioned threaded rod 30 passing through a pivoting block 32 mounted on support arms 46, the other end of the threaded rod 30 terminating in a rod end bearing 29 fastened around a horizontal bar 28 which extends between the pivot arms 20 at either end of the top roll 10, ensuring coordinated movement of the top pivot arms 20. The end of rod 30 opposite the rod end bearing 29 is provided with stop lock nuts 34 engaging the pivot block 32 to assist in the stopping and positioning of the top pivot arms 20 thus to position the top blade 16 relative to the line of centers of the two rolls, as shown by the upper right diagonal arrow in FIG. 1.

The blade 16 contacting the bottom roll 12 is mounted on a blade holder 18 that is affixed to a pair of bottom pivoting arms 22 at either end of the bottom roll 12, the blade 16, the blade holder 18, and bottom pivoting arms 22 constituting another blade assembly. The bottom pivot arms 22 pivot about the central axis of the bottom roll 12, as indicated by the lower right arcuate arrow in FIG. 1, in such a manner that the blade 16 maintains a substantially constant angular relationship with the surface of the bottom roll 12 as its position with respect to the line of centers of the two rolls is adjusted. The pivoting action of the bottom pivot arms 22 can be effected by a pair of double-action air cylinders 38, providing up and down movement as demonstrated by the lower right two-headed arrow in FIG. 1, connected to the bottom pivot arms 22 through clevises 36. The double-action air cylinders 38 are connected through clevises 40 to mounting jacks 42 which allow for small incremental adjustments of the bottom blade assembly. The mounting jack wheel 44, mounted on a shaft extending between the pair of mounting jacks 42 to coordinate their movement, provides the capability for finer, potentially infinitely variable adjustments to a precision of less than about 0.001 inch, and enable the in and out adjustment, and positioning, of the blade 16 on the bottom roll 12 over a range of about 0.75 inch.

The rotating cantilever arms 48 are raised and lowered, as shown by the left diagonal arrow in FIG. I, by a pair of double-action air cylinders 58, attached at one end to their respective rotating cantilever arms 48 through clevises 50, and at their other ends through clevises 60 to respective main side walls 62 of the machine, generally at places other than the generally separate attachments of the rotating cantilever arms 48, and the bottom roll 12 bearings 14 to the main side walls 62 of the machine. The double-action air cylinders 58 are provided at their upper portions with stop plates 54 with stop screws 56 governing the degree of rotation of the rotating cantilever arms 48. Lock nuts 52 are mounted atop the double-action air cylinders 58 between the stop plates 54 and the clevises 50 to fasten the stop plates 54 to the cylinders 58.

Figure 2:
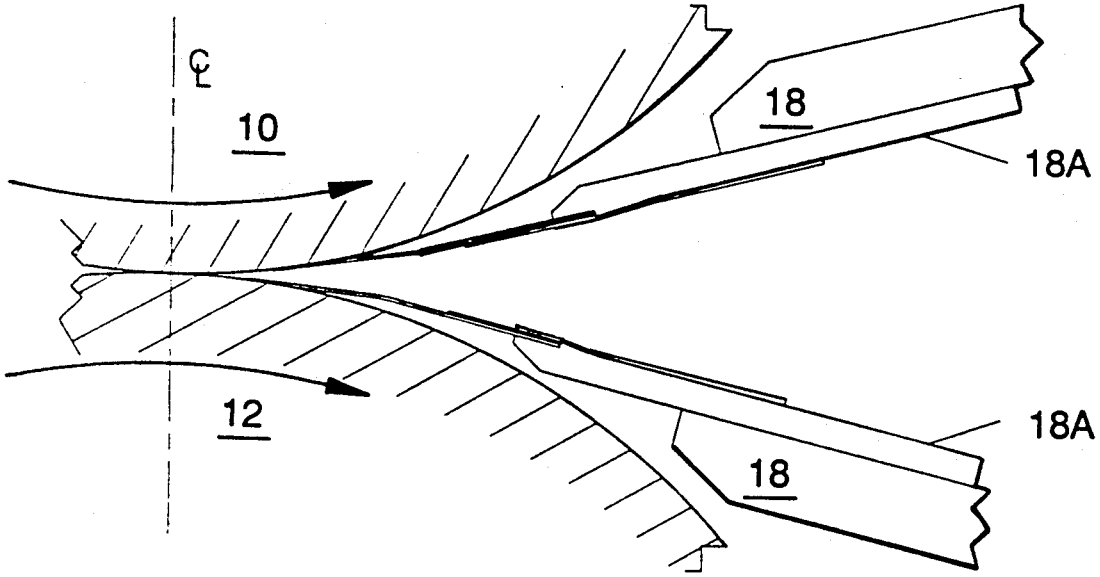
Figure 2A:
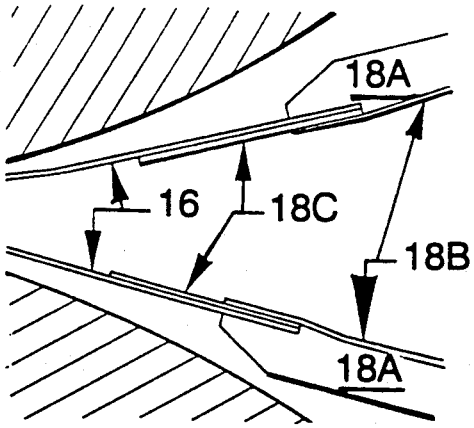
FIG. 2*a* is an enlarged view of a portion of FIG. 2.
Figure 2B:
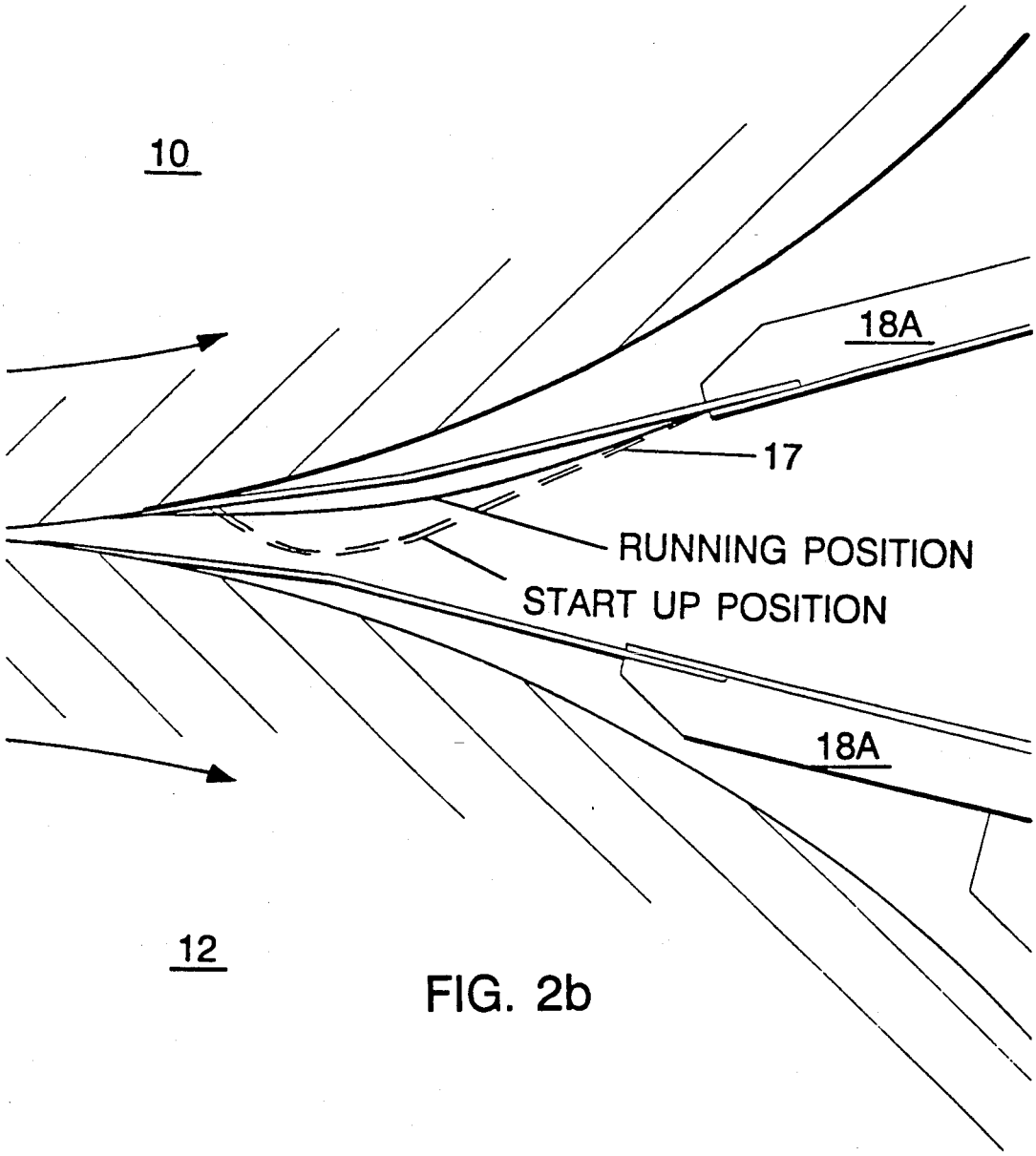
FIG. 2*b* is a detail of an end view of an alternative embodiment of a machine assembly according to another preferred embodiment of the invention showing a valve-like member associated with the blade assembly in both start-up and running positions.

We now refer to FIGS. 2 and **2*a*, details of the end view of FIG. 1 showing the nip and portions of the blade assemblies. The two counter-rotating rolls 10 and 12 are shown rotating in the directions of the respective arrows, generally both rolls being driven at substantially the same speed. Generally, the bottom blade 16 (see the enlarged view given in FIG. 2*a*) is closer to the nip, i.e. the line of centers of rolls 10 and 12, and is subject to adjustment to "fine tune" the process. The blade holders 18 are seen to be comprised of blade supports 18*a* and several retaining plates 18*b* and 18*c* in FIG. 2*a*, biasing the blades 16 against their respective blade supports 18*a* and the rolls 10 and 12**.

A detail of an end view of an alternative embodiment of a machine assembly according to another preferred embodiment of the invention is given in FIG. **2*b* showing a valve 17 disposed on the surface of the upper blade 16 that is facing away from the surface of the upper roll 10. The valve 17 is sandwiched between the blade 16** and a retaining plate at the upstream end of the upper blade support 18*a*, and is associated with the upper blade assembly. The dashed lines are a phantom image of the valve 17 as it typically appears at the start-up of the device, before the web material has advanced downstream of the nip. The valve 17 in such a start-up position facilitates the establishment of a compacted web column in the treatment cavity between the nip and the tip of the bottom blade 16. The solid lines for the valve 17 depict the running position of the valve 17 during the running of the machine, the web material flowing over the surface of the valve 17 serving generally to compress the valve 17 toward the upper roll 10 surface. The valve 17 in such a running position functions principally in a buffering capacity.

Figure 3:
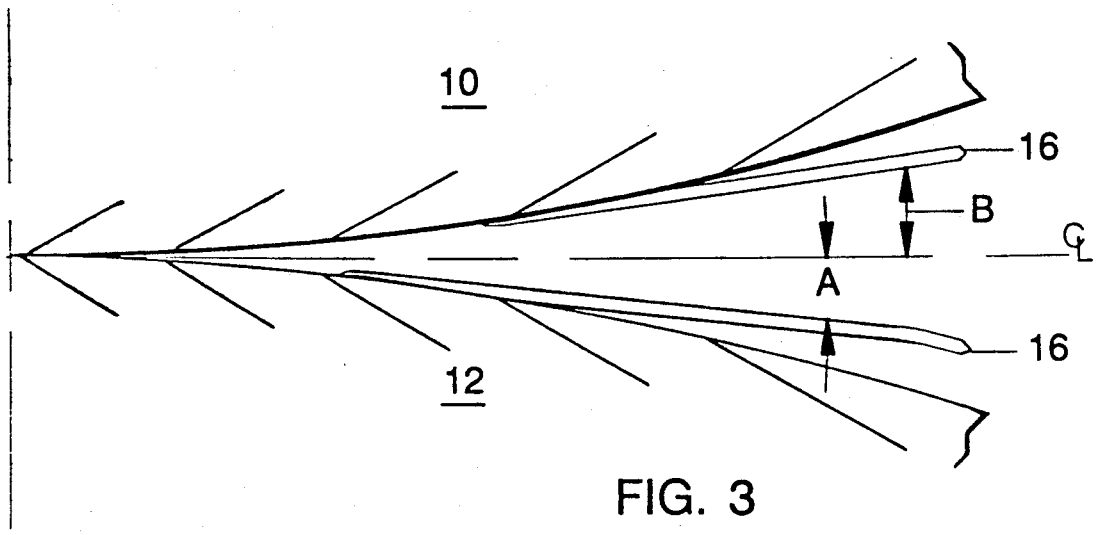
FIG. 3 shows angles A and B of the retarders in FIGS. 2 and 2*b;*

It is important to note that in running position the surfaces of the blades defining the retarder passage diverge at least slightly from one another downstream from the tips of the blades. FIG. 3 shows the angle A between the surface of the blade 16 facing away from bottom roll 12 and the central tangent plane perpendicular to the line through the centers of the rolls 10 and 12, and shows the angle B between the surface of the blade 16 facing away from the top roll 10 and the central plane. Both angles A and B are preferably greater than 0°, and may be as much as 5°. The angles on each side contribute to the divergence properties of the overall retarding channel formed between the surfaces of the blades 16 facing away from the rolls 10 and 12.

Figure 4:
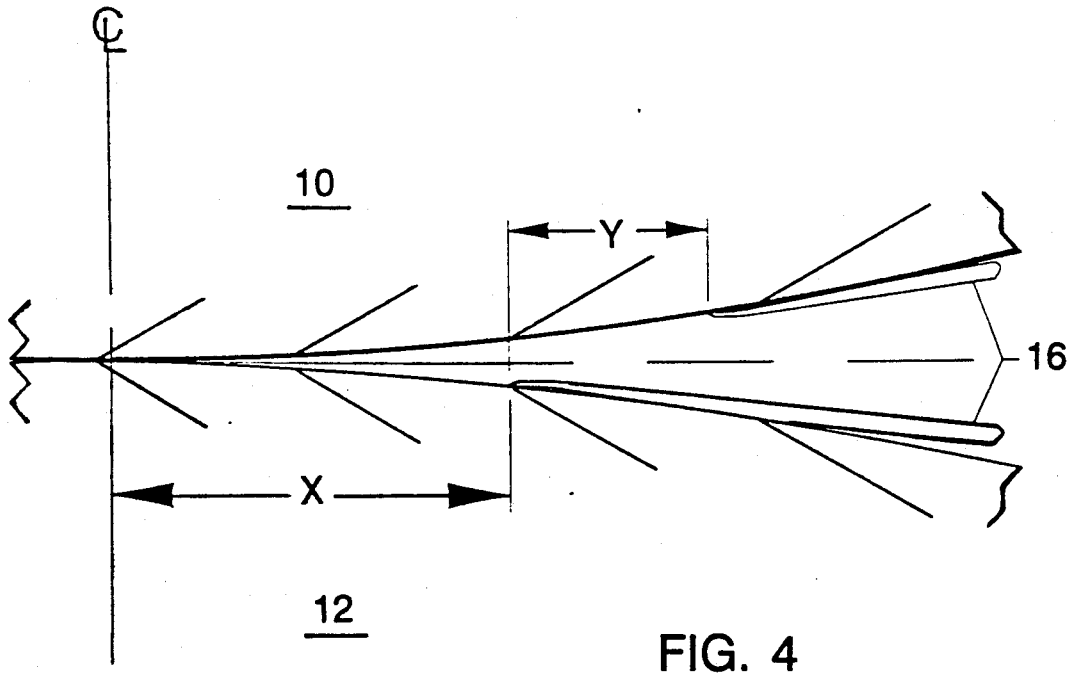
FIG. 4 shows distances X and Y to the tips of the retarder blades in FIGS. 2 and 2*b;*

FIG. 4 shows the distance X between the nip line and the upstream tip of the blade 16 substantially touching the bottom roll 12, and shows the distance Y between the upstream tip of the blade 16 substantially touching the bottom roll 12 and the upstream tip of the blade 16 substantially touching the top roll 10. By way of example, for a polypropylene web material of 0.005 inch thickness, the distance X is typically about 0.450 inch and the distance Y lies in the range 0.090 inch to 0.100 inch. Preferably the distance Y is positive, with the upstream tip of the blade 16 substantially touching the top roll 10 lying downstream of the upstream tip of the blade 16 substantially touching the bottom roll 12.

Figure 5:
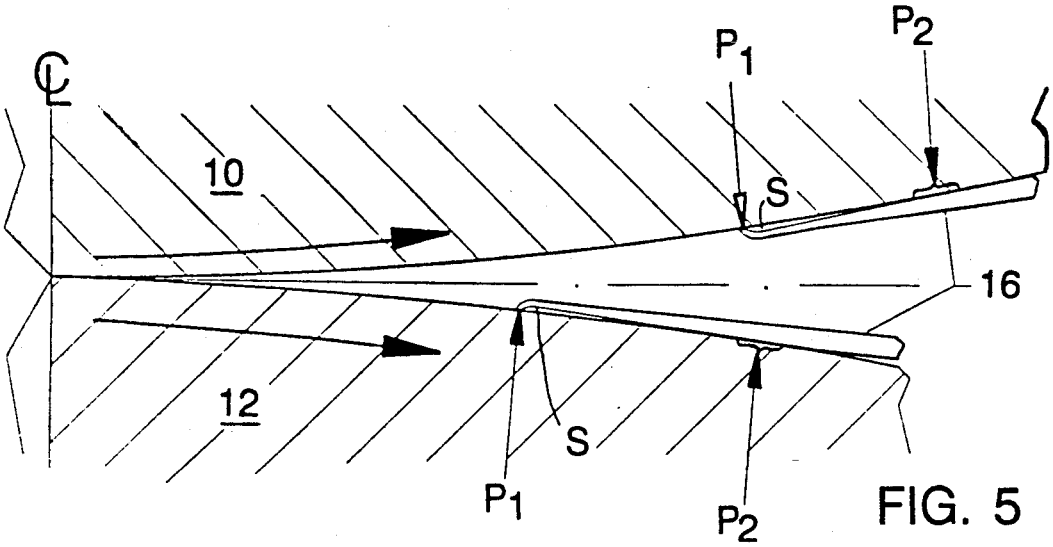
FIG. 5 shows areas of contact $P_1$ and $P_2$ of each of the blades of FIG. 1 with the respective rolls and FIGS. 5*a* and 5*b* are detail views of increasing scale of the points of contact in FIG. 5.
Figure 5A:
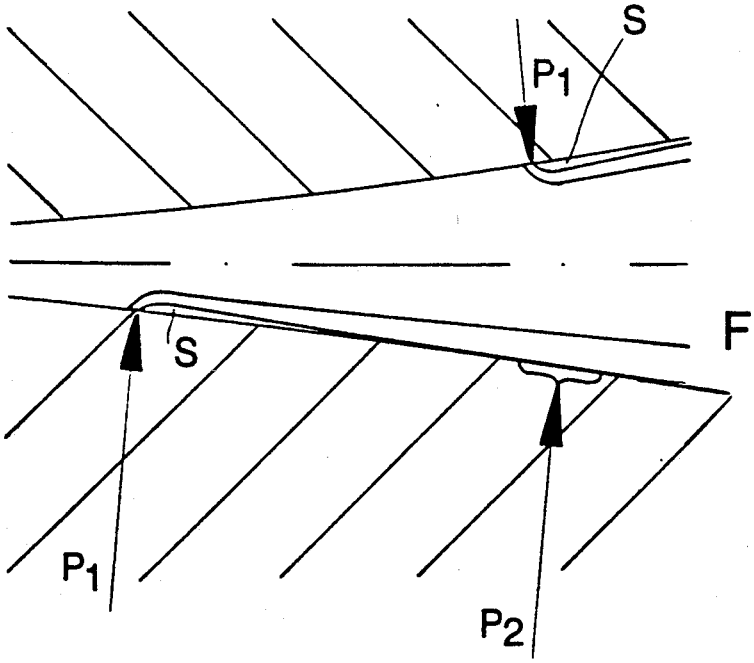

Referring to FIGS. 5 and 5*a*, the contact points $P_1$ and $P_2$ of the blades 16 with their respective rolls 10 and 12 are illustrated. The detail view shows that the point of contact $P_1$ at the upstream tip of the blade 16 is in general a smaller area of contact than the points of contact $P_2$ at the heel region of the blade 16, indicated by the bracket. An enlarged detail view of the point of contact $P_1$ is given in FIG. 5*a*. It will be noted that the portion of the blade extending upstream toward the tip is of cantilever form, preferably as mentioned, tapering linearly to a thin edge at the tip. Such construction contributes to the web-responsiveness of the tip, mentioned above.

Figure 5B:
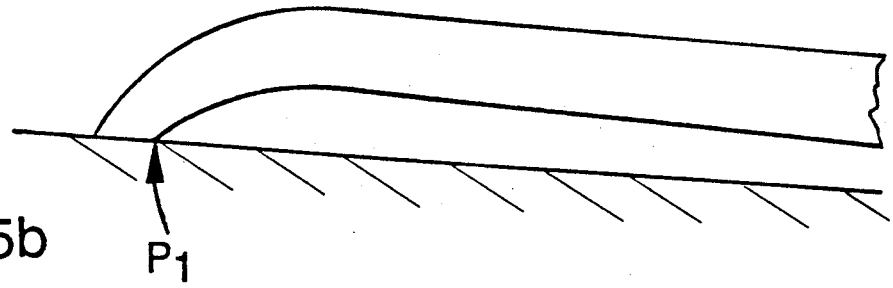

As best shown in FIG. 5*b*, the extreme tip of the blade wears slightly during initial operation to match the contour of the roll as shown, and then does not wear rapidly.

Figure 6:
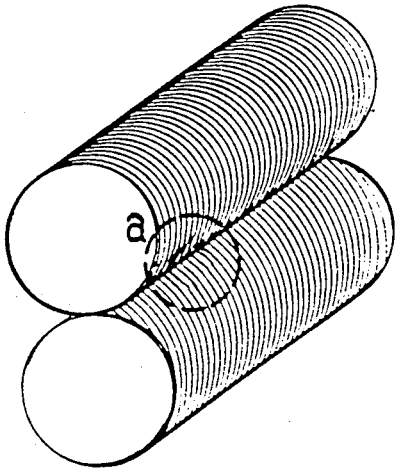
FIG. 6 shows the groove rolls of the preferred embodiment of FIG. 1 together with a magnified view of the grooves at the nip of the rolls.
Figure 6A:
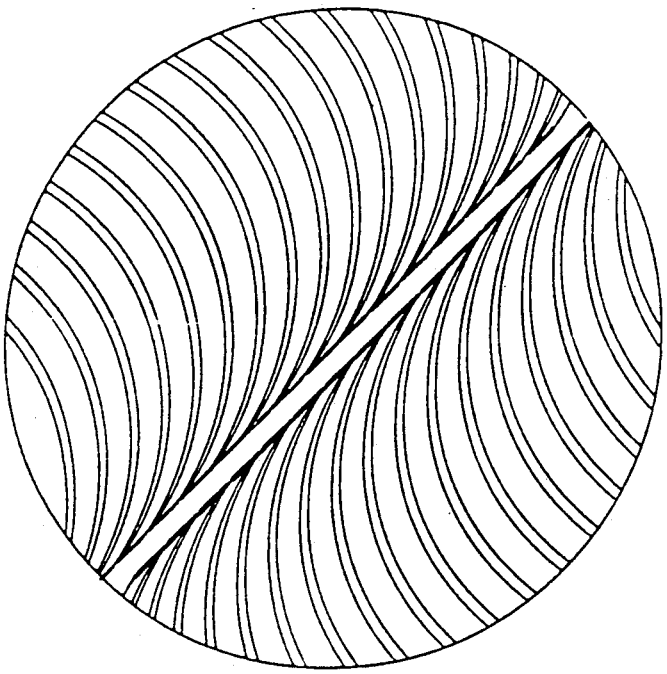

The grooves at the nip of the rolls are shown in FIG. 6, a cross sectional detail. As shown, the grooves in the upper roll are inclined to the left with respect to the direction of travel of the web, and the grooves in the lower roll are inclined oppositely, to the right with respect to the web travel direction.

Figure 7:
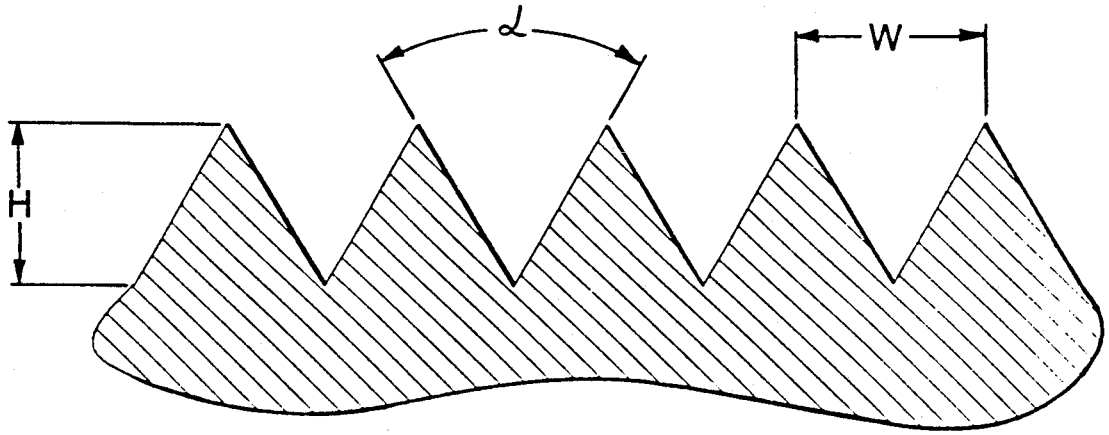
FIG. 7 shows a cross section of a fully grooved roll surface useful by itself in another embodiment and at an early stage of manufacture of the embodiment of FIGS. 1 and 8.
Figure 8:
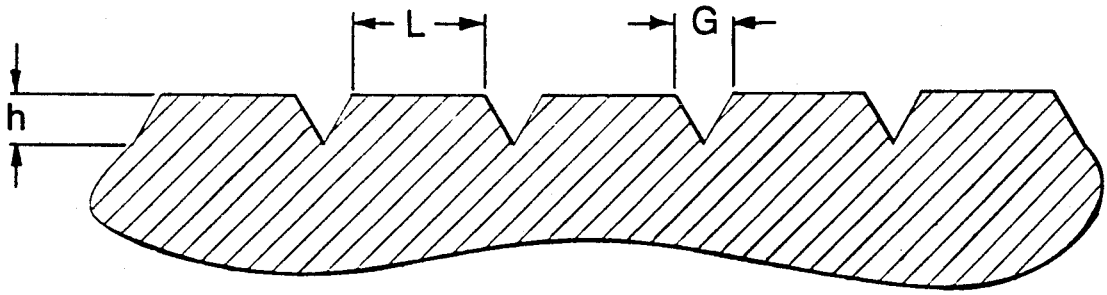
FIG. 8 shows a view similar to FIG. 7 of the rolls of FIG. 1 when manufacture is complete.

A cross sectional view of a portion of a roll surface is presented in FIG. 7 which represents a surface of the preferred embodiment as it appears at an earlier stage of manufacture (but is useful as-is for certain materials, as noted above). The peaks of the grooves have height H, preferably 0.015 inch, and the distance from peak to peak is W, preferably 0.020 inch. The angle $\alpha$ is the angle of the valley of the grooves. A preferred embodiment has an angle $\alpha$ of approximately 60°. A later stage of manufacture of the roll surface of the preferred embodiment in FIG. 7 is given in FIG. 8. The tops of the peaks in FIG. 7 have been ground off leaving the mesa shapes of height h, where preferably H=2.5 h, as shown in FIG. 8. The width of the land portions on top of the mesas is L and the width of the grooves between the lands is G, where preferably, L=2.5 G.

Figure 8A:
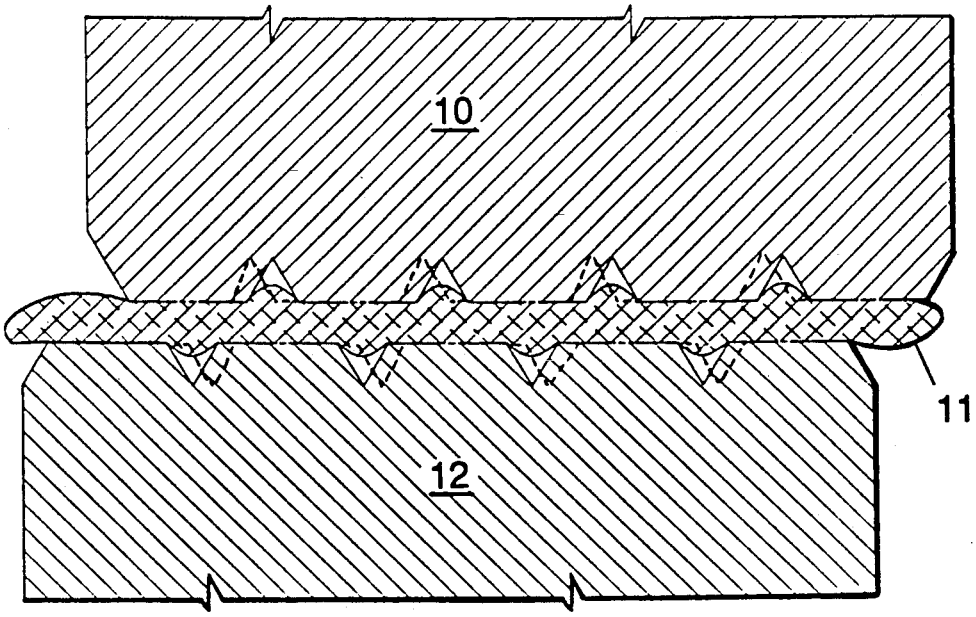
FIG. 8*a* is a diagrammatic representation of a cross section of the nip of the rolls of FIG. 1 with web material therebetween.
Figure 9:
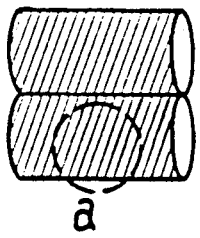
FIG. 9 is a diagrammatic, perspective detail view of the roll surface of FIG. 8.
Figure 9A:
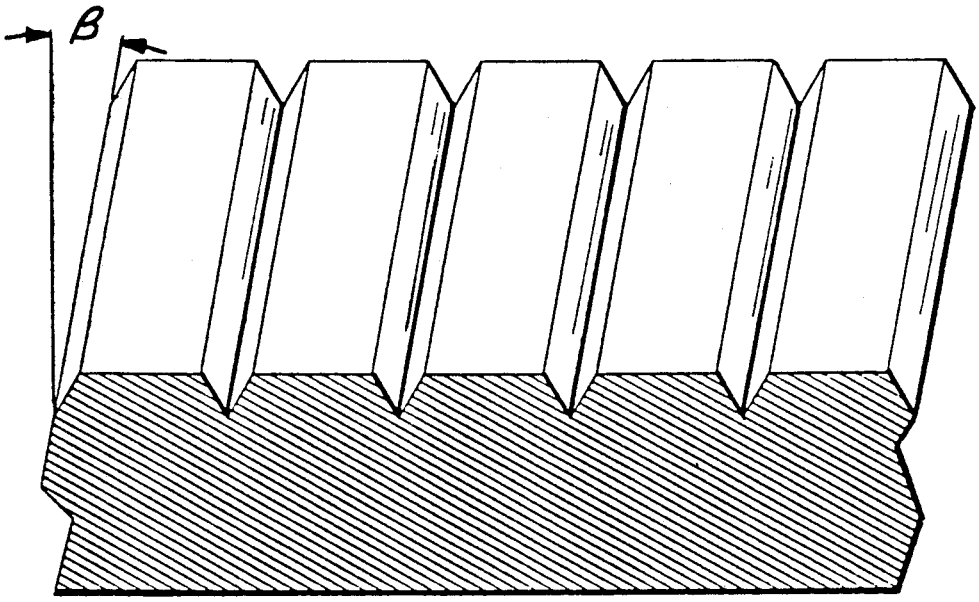

FIG. 8*a* shows a cross section of a portion of the nip of the rolls of FIG. 8 driving forward a web material 11. Small indentations of the web material 11 enter into the spaces provided by the grooves. Shown in phantom by the dotted lines is the position of the rolls 10 and 12 and the web material 11 at a slightly later time as the web material 11 is driven through the nip. The movement of the relative positions of the grooves is a result of the grooves being inclined at an angle $\beta$, preferably 20°, with respect to the direction of travel of the web, as shown in FIG. 9.

Figure 10A:
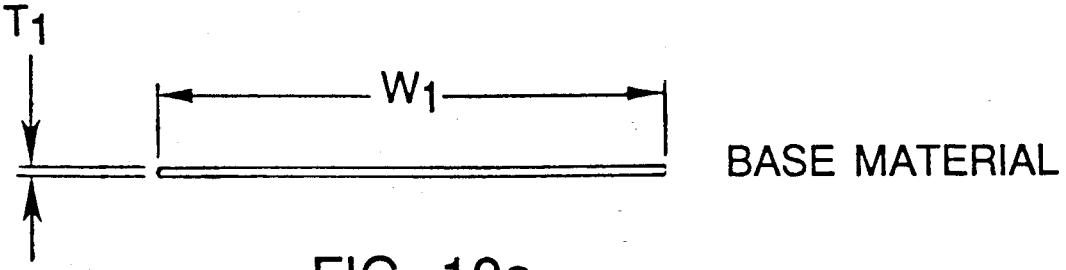
Figure 10B:
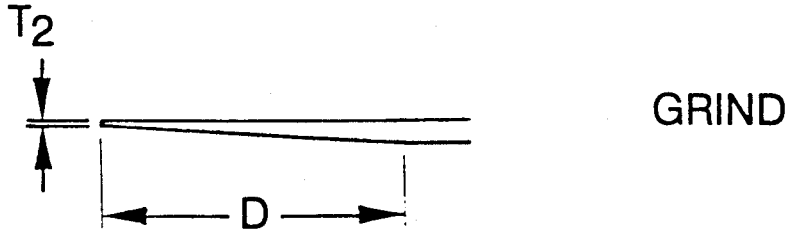
Figure 10C:
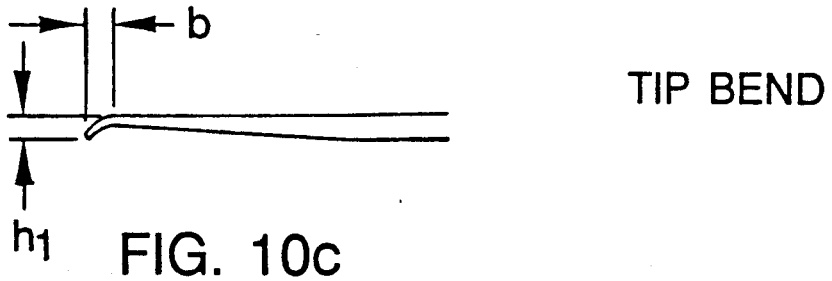
Figure 10D:
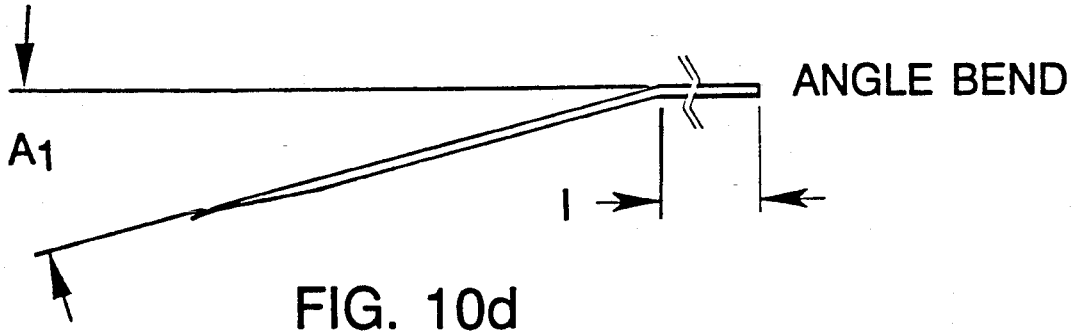

Various stages in the manufacture of the blades 16 are shown in FIGS. 10*a–d*. The base material shown in FIG. 10*a*, preferably blued steel, has an overall width $W_1$, preferably 2.5 inch, and an initial thickness $T_1$, preferably 0.020 inch. The grind down to the final tip thickness $T_2$, preferably 0.004 inch, extends over a distance D, preferably 0.25 inch, as shown in FIG. 10*b*. The end portion of length b, preferably about 1/32 to 1/16 inch, of the tip of the blade 16 is bent down through a distance $h_1$, preferably about 0.010 to 0.014 inch, from the plane of the surface of the back of the blade 16, as shown in FIG. 10*c*. At a distance much greater than D from the bent tip of the blade 16, preferably one inch, there is a bend of the blade 16 through an angle $A_1$, preferably 15°, as shown in FIG. 10*d*. The remainder of the width $W_1$ to the right of the bend is 1.

Figure 10E:
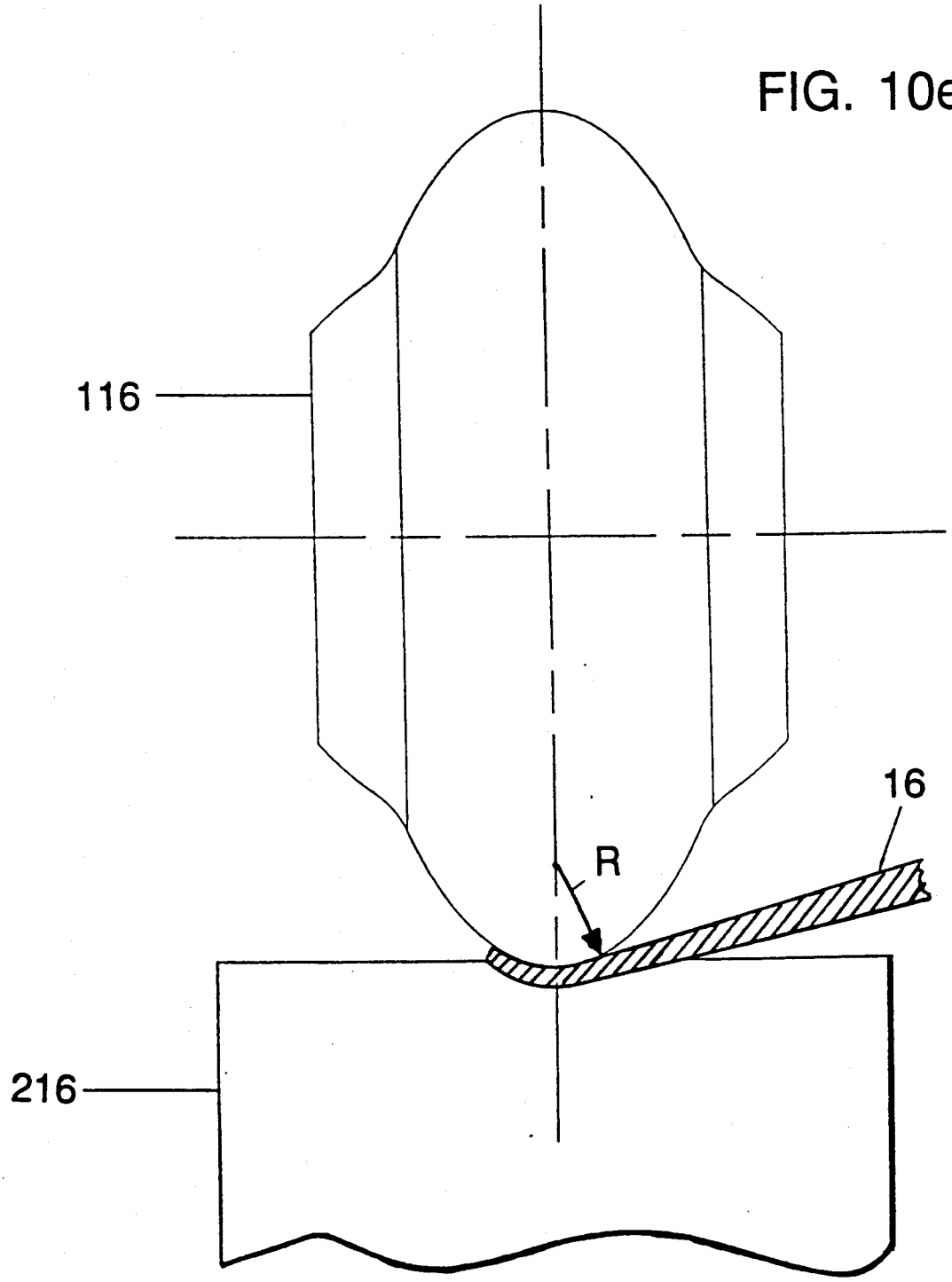
FIG. 10*e* is an end view of a device used in the bending of the tip of the blade.

An end view is given in FIG. 10*e* of the preferred manufacture of the bend in the tip of blade 16. A steel roll 116 having an axis oriented widthwise of the blade 16 has a bottom portion with radius of curvature R, preferably 1/32 to ¼ inch, that bears down hard upon the tip portion of the blade 16, the tip extending slightly beyond the plane of symmetry of steel roll 116. A hard but somewhat resilient nylon cylinder 216, with axis parallel to that of roll 116, serves as an anvil roller upon which the blade 16 tip portion rests. The rolling process is performed along the entire length of the blade, in manner to locate the curve as near to the tip as possible while still preserving the straightness of the extreme edge of the metal blade.

Figure 11:
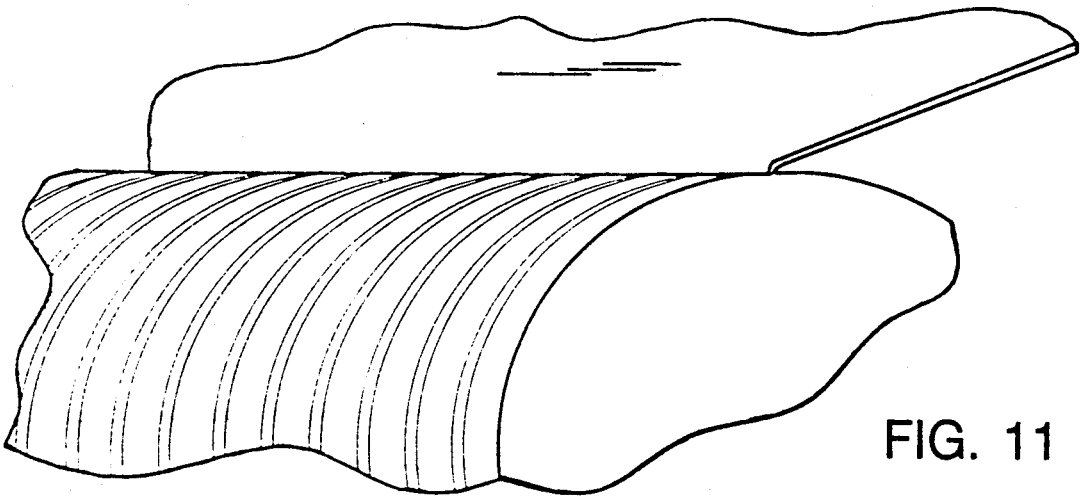
Figure 11A:
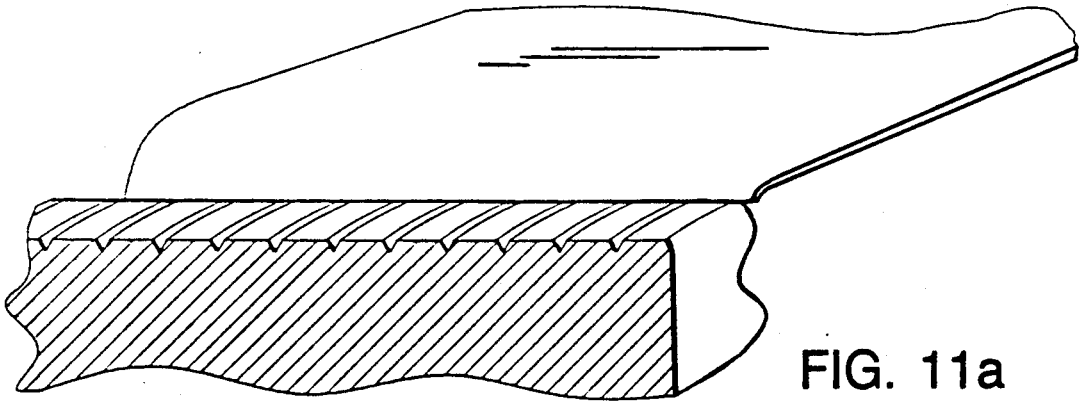
FIG. 11*a* is another diagrammtic, perspective view of the blade and roll showing further details.

A diagrammatic perspective view of the blade 16 contacting the bottom roll 12 is shown in FIG. 11. A cross section of the view in FIG. 11 is depicted in FIG. 11*a*, showing a portion of bottom roll 12 in cross section revealing the grooving of the surface.

While the presently preferred embodiment has been described, it will be understood that many variations are possible within the spirit and scope of the claims given below.

We claim:

1. A machine for longitudinal compressive treatment of a web comprising at least one drive roll, means for pressing the web against the roll in a drive region to cause the web to be driven forward and means for retarding the forward progress of the web to cause longitudinal compressive treatment of the web in a treatment cavity downstream of the drive region and in advance of said retarder means, said treatment cavity defined by the forward surface of said roll and a cooperating opposed surface, said retarder means comprising a retarder blade disposed adjacent said roll and providing a web-contacting slide surface to which the longitudinally compressed web transfers and upon which it slides as it leaves said roll, said retarder blade having two spaced-apart roll-contacting regions disposed toward said roll, one of said roll-contacting regions being at the forward tip of the blade near said drive region and the second roll-contacting region being at a heel region spaced downstream therefrom, said blade extending in cantilever fashion from said heel region to said tip region, the thickness and shape of the tip region of said blade and the length between said heel and tip regions enabling the tip of said blade to be deflectable by oncoming longitudinally compressed material to maintain proximity of the tip to the roll surface along the length of the roll in manner inhibiting diving or snagging of said material at said tip, thereby to promote the smooth, even exiting movement of the material from the treatment cavity.

2. The machine of claim 1 wherein the distance between said heel and tip roll-contacting regions is of the order of ¼ inch or less.

3. The machine of claim i wherein said blade comprises a blue steel member having a main body of substantially uniform thickness and a forward region of less than ½ inch length reduced in thickness from said main body to the tip.

4. The machine of claim 3 wherein the thickness of said tip is about 0.005 inch or less and the main body has a thickness greater than 0.010 inch.

5. The machine of claim 4 wherein the main body has a thickness of about 0.020 inch or greater.

6. The machine of claim 1 wherein the forward part of said blade tapers evenly over a length of less than one half inch to a thickness less than 0.005 inch at said tip.

7. The machine of claim 1 wherein the tip of said blade is curved, the radius of curvature of said tip being in the range of about 1/32 to ¼ inch.

8. The machine of claim I wherein said means for pressing the web against the roll comprises a second roll.

9. The machine of claim 8 wherein said retarder means comprises a second blade of like construction to the blade defined in claim 1, said second blade engaged in said two-region contact with said second roll.

10. The machine of claim 8 where the diameter of each of said rolls is greater than 8 inches.

11. The machine of claim 8, the driving surfaces of each of said rolls comprising a series of principal web-gripping grooves extending in only one direction helically about the roll axis, there being between about 20 to 80 grooves per inch and the grooves extending at an angle to the direction of travel of the web between about 10° to 35°, at the nip line of said rolls the angle of said grooves of one roll inclined positively relative to the direction of travel of the web, and the angle of the other roll inclined negatively relative to the direction of travel of the web.

12. A machine for compressive treatment of a web comprising a pair of drive rolls defining a nip for driving the web forward and retarder means for retarding the forward progress of the web to cause compaction of the web in the cavity between the rolls downstream of the nip, the driving surfaces of each of said rolls comprising a series of principal web-gripping grooves extending in only one direction helically about the roll axis, there being between about 20 to 80 grooves per inch and the grooves extending at an angle to the direction of travel of the web between about 10° to 35°, at the nip line of said rolls the angle of said grooves of one roll inclined positively relative to the direction of travel of the web, and the angle of the other roll inclined negatively relative to the direction of travel of the web.

13. The machine of claim 12 wherein there are smooth-surfaced lands between said grooves, upon which said web slides as it is compacted.

14. The machine of claim 13 wherein said lands are wider than said grooves.

15. The machine of claim 14 wherein said lands are at least twice as wide as said grooves.

16. The machine of claim 14 wherein said lands are between 2 and 4 times as wide as said grooves.

17. The machine of claim 10 wherein said grooves are "V" shaped grooves formed by knurling.

18. The machine of claim 13 wherein said grooves are formed by knurling followed by a metal removal operation removing outer portions of the knurled formation.

19. The machine of claim 18 wherein said metal is removed by grinding.

20. The machine of claim 12 wherein the grooves are all at a preselected, single angle within said range of about 10° to 35° and the number of grooves per inch is in accordance with the angle selected from the following groups: 35° angle, pitch of 20; 30° angle, pitch of 30; 25° angle, pitch of 40; 20° angle, pitch of 50; 15° angle, pitch 60; 10° angle, pitch of 70.

21. A machine for compressive treatment of a web comprising a pair of drive rolls defining a nip for driving the web forward and retarder means for retarding the forward progress of the web to cause compaction of the web in the cavity between the rolls downstream of the nip, the driving surfaces of each of said rolls comprising a series of principal web-gripping grooves extending in only one direction helically about the roll axis, at the nip line of said rolls the angle of said grooves of one roll inclined positively relative to the direction of travel of the web, and the angle of the grooves of the other roll inclined negatively relative to the direction of travel of the web.

22. A method for compressive treatment of a web employing a pair of drive rolls defining a nip for driving the web forward and retarder means for retarding the forward progress of the web to cause compaction of the web in the cavity between the rolls downstream of the nip, wherein the web is driven forward by rolls having driving surfaces each comprising a series of principal web-gripping grooves extending in only one direction helically about the roll axis, at the nip line of said rolls the angle of said grooves of one roll inclined positively relative to the direction of travel of the web, and the angle of the other roll inclined negatively relative to the direction of travel of the web.

23. The machine of claim 21 in which there are between about 20 to 80 grooves per inch and the grooves extend at an angle to the direction of travel of the web between about 10° and 35°.

24. The machine of claim 21 in which, there are smooth-surfaced lands between said grooves, upon which said web slides as it is compacted.

25. The machine of claim 21 wherein said retarder means comprises a retarder blade disposed adjacent one of said rolls and providing a web-contacting slide surface to which the longitudinally compressed web transfers and upon which it slides as it leaves said roll, said retarder blade having two spaced-apart roll-contacting regions disposed toward said roll, one of said roll-contacting regions being at the forward tip of the blade near said drive region and the second roll-contacting region being at a heel region spaced downstream therefrom.

26. The machine of claim 25 wherein said blade has a body that is thicker at said second heel region than at said tip region, the tip of said blade being curved toward said roll, said blade being mounted downstream in a manner that causes said blade to engage said roll at said heel region, said blade extending in cantilever fashion from said region to said tip region, the thickness of the tip region of said blade and the length between said heel and tip regions enabling the tip of said blade to be deflectable by oncoming longitudinally compressed material to maintain proximity of the tip to the roll surface along the length of the roll in manner inhibiting diving or snagging of said material at said tip, thereby to promote the smooth, even exiting movement of the material from the treatment cavity.

27. The machine of claim 25 wherein said retarder blade is located forward of a second blade held adjacent the other of said rolls.

28. The machine of claim 21 wherein said second blade comprises a resilient valving member.

29. The machine of claim 27 or 28 wherein, during running condition, the passage defined between said blade members diverges continuously in the downstream direction from the tips of said blades.

30. The machine of claim 21 wherein said retarder means comprises a single retarder blade, the forward part of which is held adjacent one roll and a downstream surface of which having a retarding quality is adapted to be pressed toward the opposite roll to engage and retard the exiting material.

31. A machine for longitudinal compressive treatment of a web comprising at least one drive roll, means for pressing the web against the roll in a drive region to cause the web to be driven forward and means for retarding the forward progress of the web to cause longitudinal compressive treatment of the web in a treatment cavity downstream of the drive region and in advance of said retarder means, said treatment cavity defined by the forward surface of said roll and a cooperating opposed surface, said retarder means comprising a retarder blade disposed adjacent said roll and providing a web-contacting slide surface to which the longitudinally compressed web transfers and upon which it slides as it leaves said roll, said retarder blade having two spaced-apart roll-contacting regions disposed toward said roll, one of said roll-contacting regions being at the forward tip of the blade near said drive region and the second roll-contacting region being at a heel region spaced downstream therefrom, the blade having a body that is thicker at said second heel region than at said tip region, the tip of said blade being curved toward said roll, said blade being mounted downstream in a manner that causes said blade to engage said roll at said heel region, said blade extending in cantilever fashion from said heel region to said tip region. the thickness of the tip region of said blade and the length between said heel and tip regions enabling the tip of said blade to be deflectable by oncoming longitudinally compressed material to maintain proximity of the tip to the roll surface along the length of the roll in manner inhibiting diving or snagging of said material at said tip, thereby to promote the smooth, even exiting movement of the material from the treatment cavity.

32. The method of claim 22 in which there are between about 20 to 80 grooves per inch and the grooves extend at an angle to the direction of travel of the web between about 10° and 35°.

33. The method of claim 22 in which there are smooth-surfaced lands between said grooves upon which said web slides as it is compacted.

34. The method of claim 22 wherein said retarder means comprises a retarder blade disposed adjacent one of said rolls and providing a web-contacting slide surface to which the longitudinally compressed web transfers and upon which it slides as it leaves said roll, said retarder blade having two spaced-apart roll-contacting regions disposed toward said roll, one of said roll-contacting regions being at the forward tip of the blade near said drive region and the second roll-contacting region being at a heel region spaced downstream therefrom.

35. The method of claim 34 wherein said blade has a body that is thicker at said second heel region than at said tip region, the tip of said blade being curved toward said roll, said blade being mounted downstream in a manner that causes said blade to engage said roll at said heel region, said blade extending in cantilever fashion from said region to said tip region, the thickness of the tip region of said blade and the length between said heel and tip regions enabling the tip of said blade to be deflectable by oncoming longitudinally compressed material to maintain proximity of the tip to the roll surface along the length of the roll in manner inhibiting diving or snagging of said material at said tip, thereby to promote the smooth, even exiting movement of the material from the treatment cavity.

36. The method of claim 34 wherein said retarder blade is located forward of a second blade held adjacent the other of said rolls.

37. The method of claim 36 wherein, during running condition, the passage defined between said blade members diverges continuously in the downstream direction from the tips of said blades.

38. The method of claim 22 wherein said retarder means comprises a single retarder blade, the forward part of which is held adjacent one roll and a downstream surface of which having a retarding quality is adapted to be pressed toward the opposite roll to engage and retard the exiting material.

* * * * *

UNITED STATES PATENT AND TRADEMARK OFFICE

CERTIFICATE OF CORRECTION

PATENT NO. : 5,117,540

DATED : June 2, 1992

INVENTOR(S) : Richard R. Walton, George E. Munchbach, and Richard C. Walton

It is certified that error appears in the above-identified patent and that said Letters Patent is hereby corrected as shown below:

Col. 6, line 23, "microoreper" should be --microcreper--.
Col. 8, line 40, "lades" should be --blades--.
Col. 9, line 46, "pivotinq" should be --pivoting--.

Col. 13, claim 3, line 29, "claim i" should be --claim 1--.

Signed and Sealed this

Seventh Day of September, 1993

Bruce Lehman

*Attest:*

BRUCE LEHMAN

*Attesting Officer*

*Commissioner of Patents and Trademarks*